US008904592B1

(12) United States Patent
Filho et al.

(10) Patent No.: US 8,904,592 B1
(45) **Date of Patent: *Dec. 9, 2014**

(54) COMPRESSIVE DRYING OF FINE-BRISTLED BRUSHES

(76) Inventors: Rene Xavier Filho, North Oaks, MN (US); Simone Rodrigues Oliveira Xavier, North Oaks, MN (US)

( * ) Notice: Subject to any disclaimer, the term of this patent is extended or adjusted under 35 U.S.C. 154(b) by 548 days.

This patent is subject to a terminal disclaimer.

(21) Appl. No.: 13/104,455

(22) Filed: May 10, 2011

(51) Int. Cl.
*A46B 17/04* (2006.01)

(52) U.S. Cl.
USPC ..... 15/168; 15/169; 15/184

(58) Field of Classification Search
None
See application file for complete search history.

(56) References Cited

U.S. PATENT DOCUMENTS

| | | | | |
|---|---|---|---|---|
| 530,386 | A | 12/1894 | Boeckh, Jr. | |
| 634,570 | A | 10/1899 | Briggs | |
| 816,793 | A | 4/1906 | Harris | |
| 1,359,650 | A | 11/1920 | Amis | |
| 2,263,119 | A | 11/1941 | Cornell | |
| 2,485,068 | A | 10/1949 | Santana | |
| 2,963,150 | A | 12/1960 | Dgetluck | |
| 3,325,847 | A | 6/1967 | Meranto | |
| 3,749,233 | A * | 7/1973 | McCormick, Jr. | 206/373 |
| 4,129,918 | A | 12/1978 | Lee | |
| 4,847,939 | A | 7/1989 | Derencsenvi et al. | |
| 5,427,239 | A * | 6/1995 | Hunt | 206/372 |
| 5,543,194 | A * | 8/1996 | Rudy | 428/69 |
| 6,199,694 | B1 | 3/2001 | Van Diest et al. | |
| 6,752,267 | B2 | 6/2004 | MacPherson et al. | |
| 7,140,061 | B2 * | 11/2006 | Baker et al. | 15/168 |
| 2001/0042281 | A1 | 11/2001 | Forsline | |
| 2004/0250840 | A1 | 12/2004 | Baker et al. | |
| 2007/0056130 | A1 | 3/2007 | Baker et al. | |
| 2007/0151573 | A1 | 7/2007 | Christian | |

OTHER PUBLICATIONS

Selected pages from the website www.thebrushguard.com.
Selected pages from the website www.basicmakeup.com.
Selected pages from the webstie makeup.beautyhill.com.
Selected pages from the website www.thebrushguard.com, Oct. 27, 2011.
Selected pages from the website www.basicmakeup.com, Oct. 27, 2011.
Selected pages from the webstie makeup.beautyhill.com, Oct. 27, 2011.

* cited by examiner

*Primary Examiner* — Monica Carter
*Assistant Examiner* — Stephanie Berry
(74) *Attorney, Agent, or Firm* — Dorsey & Whitney LLP

(57) ABSTRACT

Devices and systems are disclosed for rapidly drying and shaping fine-bristled brushes. The typical device is a resilient, water permeable tubular band or sleeve, designed to surround a bundle of bristles when in a radially expanded state. An elastic restoring force exerted by the sleeve acts radially inwardly against the bundle, compacting the bristles against one another. The compaction tends to preserve or restore a desired shape of the bundle, and substantially closes interstitial regions or open spaces ordinarily present between and among the bristles. Substantial closure of the interstitial regions, along with the use of a breathable material in the fibers used to construct the sleeve, contribute to a surprising and considerable reduction in bristle drying time. A system suitable for simultaneously drying several brushes includes a flat panel supporting a plurality of the sleeves, each sleeve aligned with a receptacle for the brush handle. The panel can be formed of a compliant material that permits a selective folding of the panel to form an enclosure for the brushes.

23 Claims, 2 Drawing Sheets

COMPRESSIVE DRYING OF FINE-BRISTLED BRUSHES

BACKGROUND OF THE INVENTION

The present invention relates to the care and maintenance of brushes, and more particularly to devices and systems for promoting a more rapid drying of the bundled bristles of a brush while preserving a desired shape of the bundled bristles.

Since the early part of the nineteenth century, bristle brushes have been used to apply paint and other relatively viscous liquids to the surfaces of a wide variety of substrates. The basic brush includes a handle, a plurality of natural or synthetic bristles, and a ferrule, typically metal, for mounting the bristles to one end of the handle. The bristles are mounted as a bundle, tightly packed at the ferrule and extending away from the ferrule in the handle length direction. Depending on the brush style, the bristles are either substantially parallel, or flared in the sense of including centrally located bristles extending lengthwise and peripheral bristles slightly inclined outwardly as they extend away from the ferrule.

In either event, the bundle is composed of multiple bristles, and multiple interstitial regions or open spaces between and among the bristles. The interstitial regions tend to be elongate in the direction of the bristles, and tend to enlarge as they approach the free ends of the bristles, due either to a flaring of the bundle or to a natural taper of the bristles to pointed free ends. The interstitial regions cooperate to provide a reservoir that receives and holds the paint or other viscous substance, then releases the substance as the bundle of bristles is drawn across the surface of a substrate.

Cosmetic brushes generally are formed with considerably finer bristles than paint brushes, and are used to apply a variety of cosmetics including eyeliner, eyeshadow, blush, bronzer, and concealer, in liquid and powdered form. As with other brushes, the interstitial regions in the bristle bundle of a cosmetic brush provide a reservoir for the cosmetic, releasing the cosmetic as the brush is drawn across the user's skin.

Brushes used for artistic painting are quite similar to cosmetic brushes, and typically employ similar bristles.

Proper maintenance of brushes requires thorough cleaning of the bristles. In the case of paint brushes, the most obvious requirement is to avoid an accumulation and drying of paint in the interstitial regions, which hardens the bristles and ruins the brush. Cosmetic brushes are also subject to this requirement. Further, because they are used to apply substances to the skin, cosmetic brushes are subject to the risk of skin irritation due to a buildup of previously applied cosmetics and foreign matter. Accumulated makeup products can harbor bacterial growth which can be harmful to the skin.

Accordingly, careful users endeavor to clean brushes thoroughly, directly after use. Paint brushes typically are cleaned with low viscosity liquids such as water or paint thinner. Cosmetic brushes frequently are cleaned with water mixed with soap, shampoo, or vinegar, followed by a water rinse. Wetting the bristles leaves them highly compliant, and care must be taken to preserve the desired shape of the bundle of bristles as drying proceeds. To this end, U.S. Pat. No. 4,847,939 (Derencsenyi et al.) discloses a resilient sleeve, preferably formed of PVC, polyethylene or polypropylene. The sleeve covers the bristles, the stock and part of the handle and is formed with slots or other openings that allow passage of air or moisture to aid the drying. U.S. Pat. No. 6,199,694 (Van Diest et al.) discloses a plastic sheath with halves that resiliently flex to allow insertion and removal of the brush. The sheath is provided with vent holes to hasten drying. In U.S. Pat. No. 1,359,650 (Amis), a shaving brush holder is formed as a rubber tube that supports the shaving brush vertically. Perforations through the tube allow passage of air and moisture, although the primary purpose of the holder is said to be protecting items near the shaving brush and holder to exposure to moisture from the wet brush.

According to another approach intended to protect submerged bristles, U.S. Pat. No. 2,263,119 (Cornell) provides a perforated casing to surround a brush when submerged in a brush preservative fluid. Similarly, U.S. Pat. No. 816,793 (Harris) discloses a cup shaped holder containing a brush cleaning liquid. A ring at the top of the holder is designed to suspend the bristles in the liquid, maintaining the bush in a vertical orientation while keeping the weight of the handle off of the bristles.

U.S. Pat. No. 7,140,061 (Baker et al.) discloses a bristle preservation system directed to fine-bristled brushes, more particularly artists' brushes. The system includes an elastically deformable braided tube formed of helically wound filaments. The tube undergoes axial elongation and radial contraction (or vice versa) simultaneously in the manner of a stent or Chinese handcuff. The tube is sufficiently long to extend beyond the tips of the bristles while also surrounding and bearing against at least part of the ferrule. The tube is said to be stable enough to hold the handle and bristles in a vertical orientation with the bristles pointing down. On a website (www.thebrushguad.com) describing the patented tube, it is stated that "brushes can dry bristles down so gravity pulls moisture away from the ferrule."

The forgoing devices, although useful in certain applications, rely on convective and gravitational transfer of moisture. Thus, while tending to protect the bristles during drying to preserve the desired shape, they are unlikely to increase the rate of drying, and in some cases may even increase the drying time. Accordingly, they do not effectively address circumstances that limit the time available for drying—for example, a travel schedule with brief stays at different locations, where leaving brushes out to dry for an extended time may be difficult or impossible.

Accordingly, the present invention involves several aspects, each directed to one or more of the following objects:

- to provide a device capable of applying substantial radially inward pressure when surrounding the bristles of a brush, to promote a more rapid drying of the bristles while more effectively preserving or restoring the desired bristle shape;
- to provide a bristle drying system that relies on a moisture transfer mechanism other than convection or gravity, to substantially increase the rate of drying;
- to provide a moisture permeable cover for a bundle of bristles, capable of rapidly drying and effectively shaping the bristles without requiring a vertical orientation or suspension of the brush; and
- to provide a system for storing multiple brushes, capable of promoting rapid drying and proper shaping of the brushes when stored.

SUMMARY OF THE INVENTION

To achieve and other objects, there is provided a bristle drying and shaping assembly. The assembly includes a brush comprising a handle elongate in a longitudinal direction, and a plurality of bristles. A ferrule at a distal end of the handle supports the bristles with respect to the handle in a generally longitudinal extension away from the distal end to form a bundle composed of the bristles and interstitial regions between and among the bristles. The assembly further includes a tubular band disposed on a band axis. The tubular band has a nominal band diameter less than a diameter of the bundle when in a contracted state, and is extensible elastically along a circumference thereof to an a radially expanded state to accommodate the bundle. The tubular band surrounds the bundle with the band axis oriented substantially in the longitudinal direction and in the radially expanded state, to produce an elastic restoring force acting radially inwardly to compress adjacent ones of the bristles against one another to substantially close the interstitial regions.

Although the precise mechanisms operative under the radially inward pressure are not fully understood, compressing the bristles into contact with one another substantially reduces the volume of the interstitial regions, individually and collectively. As these regions diminish in volume, the water or other liquid they contain is forced to percolate through the bundle, migrating radially outward and axially or longitudinally toward the free ends of the bristles. The inward pressure or squeezing of the bristles together, plus a diffusion mechanism as the moisture seeks the drier ambient environment, are believed to cause what constitutes a surprisingly large reduction in the time required to fully dry the bundle of bristles.

In preferred versions of the assembly, the tubular band when surrounding the bristles is disposed distally of the ferrule, and has an axial dimension sufficiently short to leave distal end portions of the bristles exposed when the band surrounds the bundle. The spacing from the ferrule enables the band to more effectively apply pressure to, and conform to, the bundle of bristles. The exposure of distal regions of the bristles promotes moisture loss through evaporation.

In particularly preferred versions of the assembly, the tubular band is composed of intercalated fibers including circumferential fibers and axial fibers. Fibers extending circumferentially along the tubular band are resilient, while the axially extending fibers are substantially inextensible. As a result, the tubular band is expanded circumferentially (or radially) to accommodate the bundle of bristles, and then contracts circumferentially as it compresses the bundle. Meanwhile, the axial dimension of the band remains substantially constant. As compared to braided tube designs in which a radial contraction is accompanied by axial elongation, a tubular band formed according to this aspect of the invention more readily conforms to the bristles without unwanted axial movement relative to the bristles. The preferred tubular band also can expand and contract radially when surrounding the bundle of bristles, without exerting unwanted axial forces against the bristles.

Another aspect of the present invention is a brush support and drying system. The system includes a first panel. A handle retainer is attached to the first panel. The retainer is adapted for a contiguous engagement with a handle of a brush to contain the handle with respect to the first panel. A tubular band is attached to the first panel, aligned with and axially spaced apart from the retainer. The tubular band has a nominal band diameter in a contracted state, and is elastically extensible in a circumferential direction to accommodate a bundle of bristles of the brush by surrounding the bristles, thereby cooperating with the retainer to secure the brush with respect to the first panel. The tubular band is adapted to generate an elastic restoring force when surrounding the bundle of bristles. The restoring force acts radially inwardly against the bundle and is of sufficient magnitude to compress the bristles against one another to substantially close interstitial regions between and among the bristles.

The panel affords convenient storage for the brush, or several of the brushes when provided with additional pairs of the tubular bands and retainers. In one preferred version of the system, a strip of pliable and inextensible material, for example leather, is sewn or otherwise attached to the panel to form a row of side-by-side retainers. In turn, several of the tubular bands are arranged in a row spaced apart in the axial direction from the retainers. The tubular bands and retainers can be provided in different sizes to accommodate differently sized brushes.

In a further preferred version of the system, a second panel can be attached to the first panel, or a single panel structure can be formed with a pliant medial region between opposite panel sections to allow a folding of the panel sections together to form an enclosure.

In a highly preferred approach, an elongate panel structure is formed of a compliant, inextensible material such as leather. Lateral bends at two medial locations form the panel structure into three panel sections of approximately equal size. Pairs of tubular members and retainers are formed along the three sections, on one side of the panel structure. When folded along the medial regions, the panel structure encloses the brushes secured by the retainers and tubular members. When closed, the panel structure provides a convenient storage and travel case. When open, the panel structure can secure several brushes for rapid drying.

A further aspect of the present invention is a device for drying and shaping bristles of a brush. The device includes a resilient, moisture permeable tubular member disposed about a tube axis and having a nominal tube diameter in a contracted state. The tubular member is elastically extensible in the circumferential direction to allow placement of the tubular member in surrounding contiguous relation to a bundle of a brush. The bundle is composed of a plurality of bristles extending generally in a longitudinal direction and interstitial regions between and among the bristles, with the tube axis extending substantially in the longitudinal direction. The tubular member when in the surrounding contiguous relation produces an elastic restoring force acting radially inwardly against the bundle and being of sufficient magnitude to radially compress the bristles against one another to substantially close the interstitial regions.

Thus in accordance with the present invention, a bundle formed of bristles extending at least generally distally from the brush handle and ferrule is surrounded by a resilient, moisture permeable tubular member having an axis substantially aligned with the bristles. While conforming to the shape of the bundle, the tubular member compresses the bundle radially inwardly due to its elastic restoring force, substantially closing interstitial regions between and among the bristles. This results in a highly favorable combination of reduced bristle drying times, and restoration or preservation of the desired bundle shape. The shorter drying times enable users to clean their brushes under circumstances that would not allow sufficient time under conventional approaches. In addition, several of the tubular members can be paired with brush handle retainers mounted to a suitable backing or panel structure for a more convenient drying and storage and several brushes.

IN THE DRAWINGS

For a further understanding of the above and other aspects and advantages of the invention, reference is made to the following detailed description and to the drawings, in which.

Figure 11:
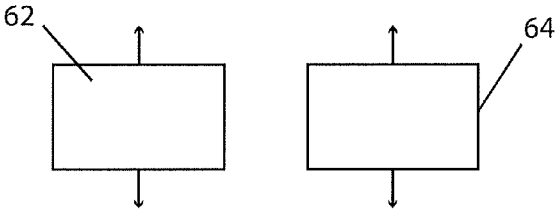
Figure 12:
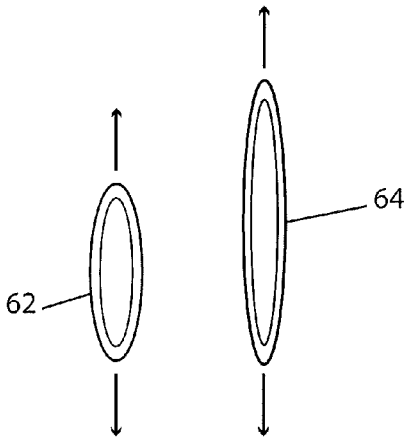

FIGS. 11 and 12 schematically represent a comparative test of circumferential elongation under an applied force.

DETAILED DESCRIPTION OF THE PREFERRED EMBODIMENTS

Figure 1:
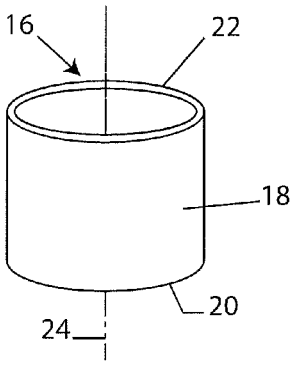
FIG. 1 is a perspective view of a bristle shaping and drying device formed in accordance with the present invention.

Turning now to the drawings, there is shown in FIG. 1 a bristle drying and shaping device in the form of a tubular member or sleeve 16. The sleeve has a wall 18 substantially uniform in size and thickness along its axial length running from a proximal end 20 to a distal end 22, vertically as viewed in the figure. The sleeve is disposed about a vertical sleeve axis 24.

Figure 2:
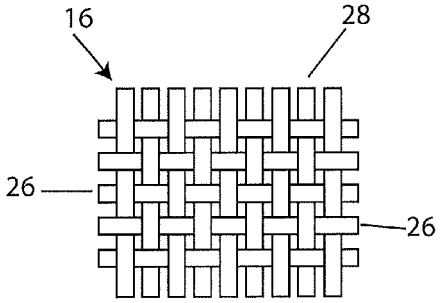
FIG. 2 is a side elevation of the device.

As seen in FIG. 2, sleeve 16 is formed of two sets of intercalated fibers: circumferentially extending fibers 26 which appear horizontal in the figure, and axially extending fibers 28 that appear vertical. Fibers 26 and 28 can be natural, e.g. cotton, or synthetic, e.g. polyester. In either event, the fibers are of two different types. The circumferential fibers are elastic, and accordingly allow elongation or expansion of wall 18 along its circumference. The axial fibers are substantially inextensible, and provide structural support for the circumferential fibers.

Figure 3:
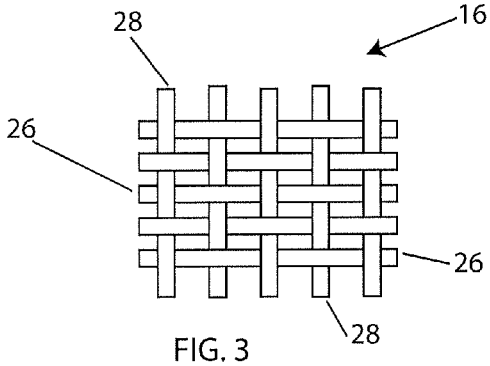
FIG. 3 is a side elevation of the device in a radially expanded state.

The combination of elastic circumferential fibers and substantially inextensible axial fibers governs the elastic expansion of sleeve 16 when subject to external forces. In particular, sleeve expansion occurs almost exclusively in the circumferential direction. This is apparent from a comparison of FIGS. 2 and 3, showing wall 18 in a relaxed state and an elastically enlarged state, respectively. In the contracted or relaxed state, assumed by the sleeve when subject to no external forces, adjacent fibers are close together and spaces between them are not visible to the naked eye. In the expanded sleeve such spaces are visible, primarily due to a substantial increase in circumferential spacing between adjacent axial fibers. The axial distance between adjacent circumferential fibers also may increase, but only slightly, due to a slight decrease in the diameter of fibers 26 as they are elongated in the circumferential direction. Thus, the elastic expansion of sleeve 16 is asymmetrical, in the sense that the axial dimension remains substantially stable as the diameter and circumference are enlarged.

Figure 4:
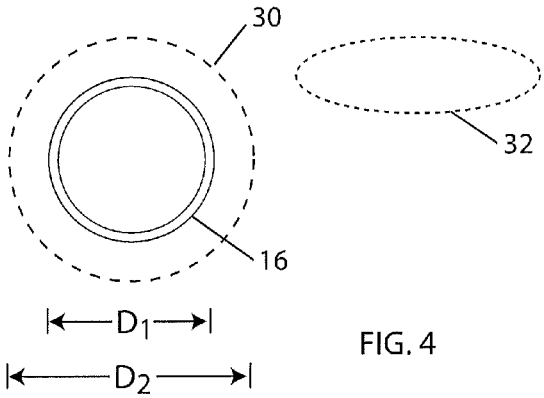
FIG. 4 is a top view of the device, showing the radially expanded state and a non-circular relaxed state in broken lines.

As seen in FIG. 4, sleeve 16 has a nominal diameter $D_1$ in the relaxed state. When surrounding the bristles of a brush and accordingly subject to a radially outward force exerted by the bristles, wall 18 is expanded to a radially enlarged state and has a diameter $D_2$. The larger diameter $D_2$, shown at 30, of course will vary with the compacted diameter of the bundle of bristles surrounded by the sleeve.

Fibers 26 and 28 are compliant, which results in a compliant sleeve. While sleeve 16 tends to assume the circular profile shown in FIG. 1 when the sleeve axis is vertically disposed, it can tend toward an elliptical profile, in some cases representing an extreme ellipse or a flattened "doubled over" appearance when placed on a surface with axis 24 substantially horizontal. Such a profile is shown in FIG. 4 at 32. The capability to assume a substantially flat configuration contributes to the ease of storing the sleeve, and does not interfere with its performance.

Sleeve 16 is water permeable when surrounding the bristles of a brush, to avoid interfering with evaporative removal of moisture from the bristles. Accordingly, it is advantageous to select circumferential and axial fibers that are water permeable. Alternatively, sleeve 16 can be formed with water impermeable versions of fibers 26 and 28, with reliance placed on the porosity created by the separation of adjacent fibers, especially the axial fibers, in the expanded sleeve. In a highly preferred version of sleeve 16, the circumferential fibers and the axial fibers are formed of mercerized cotton.

Figure 5:
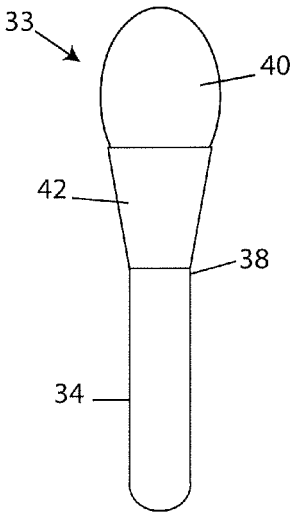
FIG. 5 is a side elevation of a cosmetic brush.

Sleeve 16 is particularly well suited for protecting the fine bristles used in cosmetic brushes and artists' brushes while promoting a more rapid drying of the bristles after cleaning. An exemplary brush 33, shown in FIG. 5, includes an elongate handle 34 having a proximal end region 36 and a distal end region 38, multiple natural or synthetic bristles arranged in a bundle 40, and a ferrule 42 surrounding the handle and the proximal ends of the bristles. The ferrule compacts the bristles, and supports bundle 40 with respect to handle 34 by virtue of its connection to the handle. Bundle 40 is flared, in the sense that only the more centrally located bristles extend in the longitudinal direction parallel to the handle, while the more peripheral bristles are slightly inclined outwardly in the distal direction. Nonetheless, all of the bristles extend at least generally in the longitudinal direction. After brush 33 is cleaned, the amount of flair may exceed a desired or designed level, due to an increase in fairing during usage or due to the wetting and handling of the bristles during cleaning. In FIG. 5, brush 33 is shown after use and shortly after cleaning, with the bristles still wet.

Figure 6:
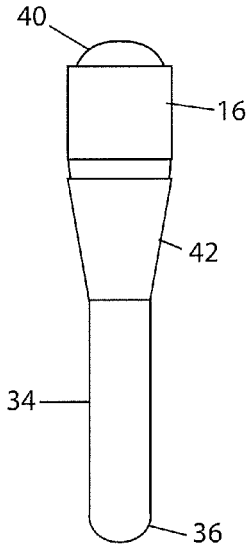
FIG. 6 is a side elevation of the brush in combination with the device.

To promote rapid drying and preserve or restore the intended shape of bundle 40, sleeve 16 is installed onto bundle 40, surrounding the bundle as shown in FIG. 6. Due to the direction of the bristles, sleeve 16 is installed by placing it over proximal end region 36, then sliding the sleeve distally over handle 34 and ferrule 42 until the sleeve is proximate but spaced apart distally from the ferrule. The initial placement and sliding along handle 34 typically are accomplished with sleeve 16 in the relaxed state, although a larger diameter handle might require slight radial enlargement. In either event, the sleeve is radially enlarged as it is moved distally along ferrule 42. This is because nominal diameter $D_1$ is less than the diameter of bundle 40, even at the proximal portion of the bundle compressed by the ferrule.

As sleeve 16 continues to move distally onto and along bundle 40, the sleeve and bundle act upon one another and conform to one another in profile. The bundle elastically expands sleeve 16 along its circumference, at a level that initially increases due to the flair of the bundle. This tendency, however, is counteracted by the sleeve, which exerts a radially inward force against bundle 40 that tends to reduce the size of the bundle. The forces of the bundle and sleeve counterbalance one another. A larger flair causes a larger circumferential or radial expansion of the sleeve, increasing the elastic restoring force, which in turn increases the tendency to compact the bundle and thereby reduce its radius.

One possible result, shown in FIG. 6, is a compaction of bundle 40 to form straight sides, with substantially all of the bristles extending in the longitudinal direction. The actual shape caused by the sleeve can vary, from a slight retention of the outward flare, to a convergence of bundle 40 in the distal direction. In all cases, the circumferential elastic restoring force in sleeve 16, and therefore the radially inward force exerted by the sleeve, is sufficient to compact the bristles, i.e. to bring adjacent bristles firmly against each other to substantially close the interstitial open regions between and among the bristles present when the bundle is not subject to the radially compressive force of the sleeve.

Figure 7:
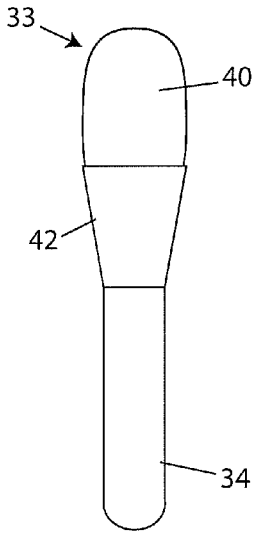
FIG. 7 is a side elevation of the brush following removal of the device.

FIG. 7 illustrates brush 33 after drying, and after removal of sleeve 16. Again due to the bristle direction, the sleeve is removed by sliding it distally relative to bundle 40. The brush shaping impact of the sleeve is illustrated by the longitudinal sides of the bundle, although actual results will vary.

Figure 8:
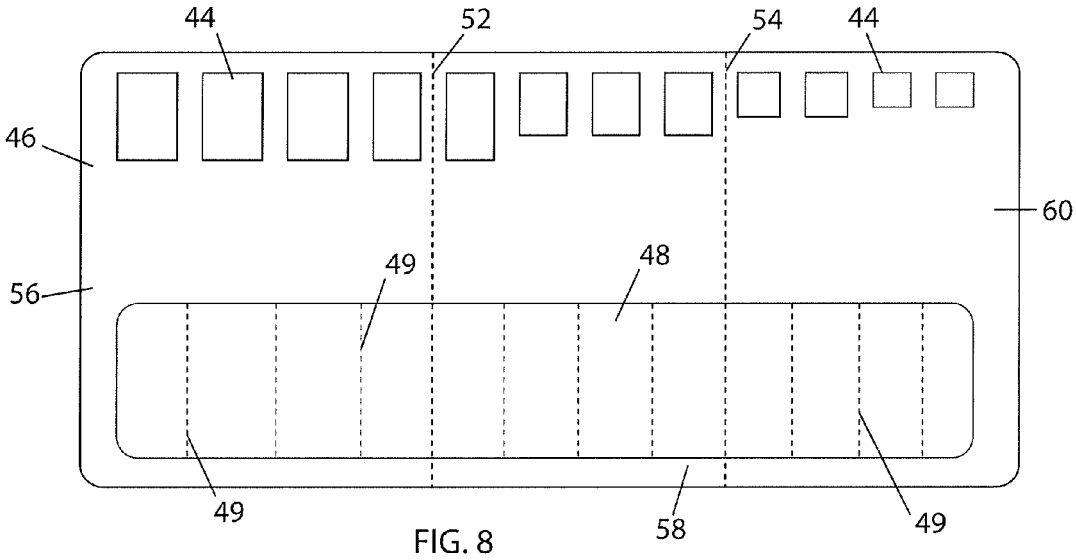
FIG. 8 is a top plan view of a storage and carrying case for cosmetic brushes.
Figure 9:
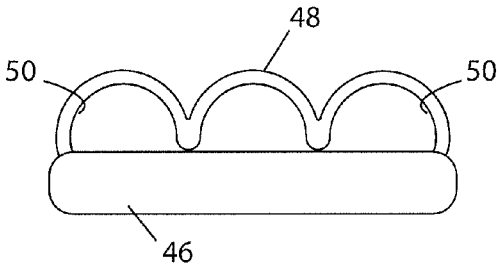
FIG. 9 is a side elevation showing a panel of the case.
Figure 10:
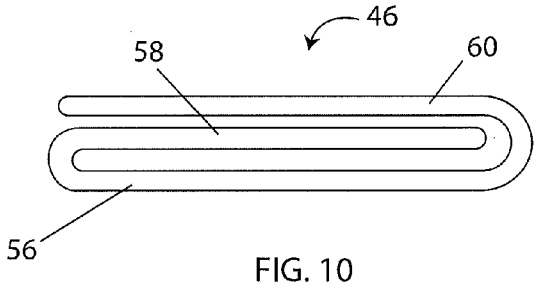
FIG. 10 is a side elevation of the case when closed.

As seen in FIGS. 8-10, a set of sleeves 44 similar to sleeve 16 can be mounted to a panel or backing to support and dry several brushes simultaneously. In FIG. 8, a platform or panel 46 is shown with a row of sleeves 44 running along one side of the panel. Each of the sleeves is sewn or otherwise attached to the panel. Near the opposite side of panel 46, a strip 48 of leather or another compliant and inextensible material is joined to the panel by stitching 49 at intervals spaced apart along the strip length and perpendicular to the length. As best seen in FIG. 9, this forms a row of handle retainers or receptacles 50, each aligned with one of sleeves 44 in the sense of being coaxial with the associated sleeve while spaced apart from the sleeve in the axial direction.

The spacing between adjacent lines of stitching 49 varies, diminishing from left to right as shown in FIG. 8. In similar fashion, sleeves 44 on the left have larger relaxed-state diameters than the sleeves on the right. Centrally located sleeves have intermediate relaxed-state diameters. As a result, the system of the panel, sleeves, and receptacles can accommodate a variety of brush sizes.

Panel 46, like strip 48, is formed of leather or another material that is compliant and inextensible. This allows the panel to be selectively bent or folded along medial panel regions indicated by broken lines at 52 and 54. Functionally, this divides panel 46 into panel sections 56, 58, and 60. When folded together, the panel sections cooperate to form an enclosure for storing or carrying multiple brushes, as shown in FIG. 10.

A salient feature of the present invention is the capacity of the sleeve, when surrounding the bundle of bristles, to compact the bristles against one another and thereby substantially close the interstitial regions between and among the bristles. In conventional open air drying, and in drying with the aid of devices that cover or surround the bristles yet purport to rely on gravity to remove moisture, convection is the mechanism primarily relied upon to remove moisture from the bristles. The radial compaction of the bristles in accordance with the present invention is counterintuitive in the context of conventional approaches, because bristle compaction removes or diminishes pathways otherwise available for convection. This notwithstanding, the use of sleeves similar to sleeves 16 and 44 has been found to considerably reduce drying times while restoring or preserving the shape of the bristles.

The substantial closure of interstitial regions between and among bristles requires a high level of radially inward force to compact the bristles, well beyond levels found in previous approaches. FIGS. 11 and 12 schematically illustrate a comparative test conducted on a sleeve 62 constructed in accordance with the present invention, and a sleeve 64 sold under the brand name "Brush Guard" and consistent with the subject matter of the aforementioned U.S. Pat. No. 7,140,061. Each of the tubular devices was subjected to a radially outward force of the same magnitude, in this case 20 oz. The force was applied along the length of each device, at a location centered between the opposite ends. The results are indicated in Table 1 below:

TABLE 1

| | Device 62 | Device 64 |
|---|---|---|
| Relaxed State Diameter | 2.6 cm | 2.0 cm |
| Diameter-Force Applied | 2.7 cm | 4.8 cm |
| Profile Expansion | 0.1 cm | 2.8 cm |

As seen from FIGS. 11 and 12, the radially outward force was exerted against two sections of the tube wall simultaneously, indicating that a similar circumferential expansion (single wall) would require significantly less force, likely about one-half. However, the comparative difference would be the same. The force applied to sleeve 62 caused an elongation of 0.1 cm, about 3.8 percent of the unstressed diameter. The same force, applied to sleeve 64, caused an enlargement of 2.8 cm, or 140 percent of the original size.

Sleeve 64 exerts a finite radially inward force against the bristles, sufficient to frictionally engage the bristles so that a portion of the tube that extends distally beyond the bristles can support the weight of the entire brush in a vertical orientation. Generally, the radially inward force sufficient to compress the bristles for substantial closure of interstitial regions, exceeds the force necessary for frictional engagement by more than an order of magnitude.

In another comparative test, brushes with natural bristles and synthetic bristles were dried using sleeve 62 and sleeve 64, both in comparison with open air drying. Brushes were tested in six groups: (1) goat hair bristles, dried using tube 62; (2) goat hair bristles dried using tube 64; (3) goat hair bristles, open air drying; (4) synthetic bristles, dried using tube 62; (5) synthetic bristles, dried using tube 64; and (6) synthetic bristles, open air drying.

The brushes were immersed in water for ten minutes. Each brush, immediately after removal from the water, was placed in contact with a highly absorbent paper for five minutes. The resulting "halo" formed by outward migration of water from the area of brush contact, was measured at its maximum diameter to obtain a halo width measurement. At that point, drying was initiated.

At four stages of drying (2 hours, 4 hours, 6 hours, and 24 hours), the halo forming and measuring step was repeated. The results are shown in Table 2:

TABLE 2

| | | | Halo Width (cm) at Time (hours) | | | | |
|---|---|---|---|---|---|---|---|
| Group 1-6 | Bristle Type | Method | 0 | 2 h | 4 h | 6 h | 24 h |
| 1 | Goat Hair | Sleeve 62 | 10 | 3.5 | 0 | 0 | 0 |
| 2 | Goat Hair | Sleeve 64 | 10.5 | 9.5 | 9 | 9 | 8.5 |
| 3 | Goat Hair | Open Air | 10 | 6.5 | 4.5 | 0 | 0 |
| 4 | Synthetic | Sleeve 62 | 12 | 5.5 | 3 | 0 | 0 |
| 5 | Synthetic | Sleeve 64 | 12 | 11 | 10 | 9 | 9 |
| 6 | Synthetic | Open Air | 12.5 | 8.5 | 7.2 | 7 | 0 |

As Table 2 indicates, in connection with the natural bristle brush dried using sleeve 62, no transfer of water to the absorbent paper was observed in the test conducted four hours after the initial wetting of the bristles. As to the synthetic bristle brush dried using sleeve 62 no such transfer was observed in the test conducted six hours after initial wetting.

In both cases, the brush was found to be completely dry and ready to use.

In contrast, the natural and synthetic brushes dried using sleeve 64 remained wet 24 hours after initial wetting, although a reduction in halo diameters over time did suggest loss of moisture. The air dried natural brush left no observable water halo when tested six hours after initial wetting. However, the brush at this point still felt humid to the touch, and for that reason was considered not yet ready for use. The air dried synthetic bristle brush left no visible water halo in the test conducted 24 hours after initial wetting.

Overall, the results indicate a substantial reduction in drying time, for natural bristles and synthetic bristles alike, when the bundle of bristles is surrounded by a water permeable tubular member in an elastically enlarged state under an elastic restoring force sufficient to compress the bristles and thereby substantially close the interstitial regions ordinarily present between and among the bristles.

Thus in accordance with the present invention, systems and devices are provided to preserve and restore the shape of a bundle of bristles, after cleaning the brush. These systems and devices substantially reduce the time required for drying, so that cleaning and drying the brushes becomes more convenient in any event. Finally, the devices and systems allow the cleaning and drying of brushes in circumstances where these activities were either difficult or impossible due to previous drying time requirements.

What is claimed is:

1. A bristle drying and shaping assembly for drying and shaping bristles of a brush, including:

a brush comprising a handle elongate in a longitudinal direction, a plurality of bristles, and a ferrule at a distal end of the handle to support the bristles with respect to the handle in a generally longitudinal extension away from the distal end to form a bundle being composed of the plurality of bristles extending generally in a longitudinal direction and interstitial regions between and among the bristles; and a resilient, moisture permeable tubular band member disposed about a tube axis of the tubular band member, the tubular band member having a nominal tube diameter less than a diameter of the bundle when in a contracted state and the tubular band member being extensible elastically in a circumferential direction along a circumference thereof to a radially expanded state to allow placement of the tubular band member in surrounding contiguous relation to accommodate the bundle of the brush, with the tube axis extending substantially in the longitudinal direction;

wherein the tubular band member when in said surrounding contiguous relation surrounds the bundle with the tube axis oriented substantially in the longitudinal direction and in the radially expanded state produces an elastic restoring force acting radially inwardly against the bundle to compress adjacent ones of the bristles against one another to substantially close the interstitial regions, wherein the elastic restoring force exceeds a level of radially inward force necessary to establish a frictional engagement of the tubular member and the bundle by more than an order of magnitude.

2. The assembly of claim 1 wherein:

the tubular band member when surrounding the bundle is disposed distally of the ferrule.

3. The assembly of claim 2 wherein:

an axial dimension of the tubular band member is less than a longitudinal extension of the bristles beyond the ferrule, whereby the tubular band member when surrounding the bundle leaves distal end portions of the bristles exposed.

4. The assembly of claim 1 wherein:

the tubular band member is substantially inextensible axially.

5. The assembly of claim 1 wherein:

the tubular band member is composed of intercalated fibers including circumferential fibers and axial fibers.

6. The assembly of claim 5 wherein:

the circumferential fibers are resilient to provide for elastic and circumferential extension of the tubular band member, and the axial fibers are substantially inextensible.

7. The device of claim 5 wherein:

the circumferential fibers and the axial fibers are water permeable.

8. The assembly of claim 5 wherein:

the circumferential fibers and the axial fibers are substantially water impermeable, and cooperate to provide a porosity in the tubular band member when the tubular band member surrounds the bundle in the radially expended state.

9. The assembly of claim 1 further including:

a first panel to which the tubular band is attached, and a handle receiver attached to the first panel aligned with and axially spaced apart from the tubular band member to contain the handle when the tubular band surrounds the bundle and thereby cooperate with the tubular band member to contain the brush with respect to the first panel.

10. The assembly of claim 9 further including:

a second panel joined to the first panel and movable relative to the first panel between an open position for allowing access to the brush, and a closed position in which the panels cooperate to form an enclosure containing the brush.

11. The assembly of claim 10 further including:

a plurality of auxiliary tubular bands and a plurality of auxiliary receivers, arranged in band/receiver pairs on the first and second panels for containing a plurality of auxiliary brushes with respect to the first panel.

12. A device for drying and shaping bristles of a brush, including:

a resilient, moisture permeable tubular member disposed about a tube axis and having a nominal tube diameter in a contracted state, the tubular member being elastically extensible in a circumferential direction to allow placement of the tubular member in surrounding contiguous relation to a bundle of a brush, the bundle being composed of a plurality of the bristles extending generally in a longitudinal direction and interstitial regions between and among the bristles, with the tube axis extending substantially in the longitudinal direction;

wherein the tubular member when in said surrounding contiguous relation produces an elastic restoring force acting radially inwardly against the bundle, wherein the elastic restoring force exceeds a level of radially inward force necessary to establish a frictional engagement of the tubular member and the bundle by more than an order of magnitude.

13. The device of claim 12 wherein:

the brush comprises a ferrule for joining the bundle of bristles with respect to a distal end of an elongate handle, and an axial dimension of the tubular member is selected to allow placement of the tubular member distally of the ferrule while leaving a distal end region of the bundle exposed.

14. The device of claim 12 wherein:

the tubular member is substantially inextensible in the axial direction.

15. The device of claim 14 wherein:

the tubular member is composed of a plurality of intercalated fibers, comprising circumferential fibers and axial fibers.

16. The device of claim 12 further including:

a first panel to which the tubular member is attached, and a substantially inextensible handle retainer substantially aligned with and spaced apart axially from the tubular member, the retainer being adapted to engage the handle when the tubular member surrounds the bundle of bristles, whereby the tubular member and the receiver cooperate to contain the brush with respect to the first panel.

17. The device of claim 16 further including:

a second panel connected to the first panel and movable relative to the first panel between an open position permitting access to the brush, and a closed position in which the panels cooperate to form an enclosure containing the brush.

18. The assembly of claim 1 wherein:

the elastic restoring force produced by the tubular band when so surrounding the bundle exceeds a level of radially inward elastic restoring force necessary to establish a frictional engagement of the tubular member and the bundle by more than an order of magnitude.

19. The device of claim 12 wherein:

the tubular member when in said surrounding contiguous relation to the bundle radially compresses the bristles against one another to substantially close the interstitial regions.

20. The device of claim 15 wherein:

the circumferential fibers are resilient to provide for the elastic and circumferential extension of the tubular band, and the axial fibers are substantially inextensible.

21. A device for drying and shaping bristles of a brush, including:

a resilient, moisture permeable tubular member disposed about a tube axis and having a nominal tube diameter in a contracted state, the tubular member being elastically extensile in a circumferential direction to allow placement of the tubular member in surrounding contiguous relation to a bundle of a brush, the bundle being composed of a plurality of the bristles extending generally in a longitudinal direction and interstitial regions between and among the bristles, with the tube axis extending substantially in the longitudinal direction;

wherein the tubular member is formed of intercalated fibers including resilient first fibers extending in the circumferential direction and substantially inextensible second fibers extended in the longitudinal direction, whereby the first and second fibers cooperate to allow a circumferential elastic expansion of the tubular member while preventing any substantial expansion of the tubular member in the longitudinal direction.

22. The device of claim 21 wherein:

the tubular member when in said surrounding contiguous relation produces an elastic restoring force that acts radially inwardly against the bundle and is of sufficient magnitude to radially compress the bristles against one another to substantially close the interstitial regions.

23. The device of claim 21 wherein:

the tubular member when in said surrounding contiguous relation produces an elastic restoring force that acts radially inwardly against the bundle and exceeds a level of radially inward force necessary to establish a frictional engagement of the tubular member and the bundle by more than an order of magnitude.

* * * * *

UNITED STATES PATENT AND TRADEMARK OFFICE

CERTIFICATE OF CORRECTION

PATENT NO. : 8,904,592 B1
APPLICATION NO. : 13/104455
DATED : December 9, 2014
INVENTOR(S) : Rene Xavier Filho and Simone Rodrigues Oliveira Xavier It is certified that error appears in the above-identified patent and that said Letters Patent is hereby corrected as shown below:

In the Claims

At column 10, line 28
"an open position for allowing"

should read:
--an open position allowing--

Signed and Sealed this
Twenty-first Day of April, 2015

Michelle K. Lee

Michelle K. Lee
*Director of the United States Patent and Trademark Office*